US007972183B1

(12) United States Patent
Lin

(10) Patent No.: US 7,972,183 B1
(45) Date of Patent: Jul. 5, 2011

(54) SLED THAT REDUCES THE NEXT VARIATIONS BETWEEN MODULAR PLUGS

(75) Inventor: Chen-chieh Lin, Lafayette, IN (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/727,786

(22) Filed: Mar. 19, 2010

(51) Int. Cl.
*H01R 24/00* (2006.01)

(52) U.S. Cl. ..... 439/676

(58) Field of Classification Search ..... 439/676, 439/660, 418
See application file for complete search history.

(56) References Cited

U.S. PATENT DOCUMENTS

| | | | | |
|---|---|---|---|---|
| 5,571,035 | A * | 11/1996 | Ferrill | 439/894 |
| 5,830,005 | A * | 11/1998 | Watanabe | 439/418 |
| 5,899,770 | A * | 5/1999 | Ezawa | 439/418 |
| 5,911,594 | A * | 6/1999 | Baker et al. | 439/404 |
| 5,989,071 | A | 11/1999 | Larsen et al. | |
| 6,010,353 | A | 1/2000 | Ensz et al. | |
| 6,042,427 | A | 3/2000 | Adriaenssens et al. | |
| 6,045,389 | A * | 4/2000 | Ferrill et al. | 439/398 |
| 6,056,586 | A | 5/2000 | Lin | |
| 6,109,954 | A | 8/2000 | Lin | |
| 6,238,235 | B1 * | 5/2001 | Shavit et al. | 439/418 |
| 6,250,949 | B1 * | 6/2001 | Lin | 439/418 |
| 6,325,660 | B1 | 12/2001 | Diaz et al. | |
| 6,402,560 | B1 | 6/2002 | Lin | |
| 6,406,325 | B1 * | 6/2002 | Chen | 439/418 |
| 6,506,077 | B2 * | 1/2003 | Nagel | 439/607.05 |
| 6,520,807 | B2 * | 2/2003 | Winings | 439/676 |
| 6,524,128 | B2 * | 2/2003 | Marowsky et al. | 439/418 |
| 6,558,204 | B1 * | 5/2003 | Weatherley | 439/676 |
| 6,561,838 | B1 * | 5/2003 | Blichfeldt | 439/418 |
| 6,695,649 | B1 * | 2/2004 | Ciezak et al. | 439/676 |
| 6,729,901 | B2 * | 5/2004 | Aekins | 439/418 |
| 6,811,445 | B2 * | 11/2004 | Caveney et al. | 439/676 |
| 6,932,641 | B1 * | 8/2005 | Liao | 439/460 |
| 6,962,503 | B2 * | 11/2005 | Aekins | 439/418 |
| 7,086,891 | B2 * | 8/2006 | Liao | 439/418 |
| 7,175,468 | B1 * | 2/2007 | Chang | 439/418 |
| 7,220,149 | B2 | 5/2007 | Pharney | |
| 7,223,112 | B2 * | 5/2007 | AbuGhazaleh et al. | 439/344 |
| 7,294,012 | B2 * | 11/2007 | AbuGhazaleh et al. | 439/418 |
| 7,374,450 | B1 * | 5/2008 | Chang | 439/418 |
| 7,425,159 | B2 | 9/2008 | Lin | |
| 7,438,583 | B2 * | 10/2008 | AbuGhazaleh et al. | 439/344 |
| 7,465,180 | B2 * | 12/2008 | Kusuda et al. | 439/352 |
| 7,513,787 | B2 * | 4/2009 | AbuGhazaleh et al. | 439/344 |
| 7,556,536 | B2 * | 7/2009 | Caveney et al. | 439/676 |
| 7,722,410 | B2 * | 5/2010 | De Dios Martin et al. | 439/676 |
| 7,736,170 | B2 * | 6/2010 | AbuGhazaleh et al. | 439/344 |
| 7,811,118 | B2 * | 10/2010 | Caveney et al. | 439/404 |
| 2002/0142644 | A1 * | 10/2002 | Aekins | 439/418 |

(Continued)

*Primary Examiner* — T C Patel
*Assistant Examiner* — Vladimir Imas
(74) *Attorney, Agent, or Firm* — Muncy, Geissler, Olds & Lowe, PLLC

(57) ABSTRACT

A connector plug terminates a communication cable having a plurality of twisted pair conductors therein. The plug includes a conductor organizing sled, which includes structural features to minimize variations in conductor organization, as the conductors pass along the sled. By minimizing the variations as the conductors pass along the sled, technicians may assemble plugs having a relatively consistent level of crosstalk. The structural features of the organizing sled may include combinations of a ramp surface for a center pair, neck-down portions to cause consistent placement of stacked pairs, and crossing of stacked pairs to prevent a lower stacked pair from rising above a floor surface of the sled.

20 Claims, 5 Drawing Sheets

U.S. PATENT DOCUMENTS

2004/0023563 A1* 2/2004 Ciezak et al. ..... 439/676
2004/0092154 A1* 5/2004 Doorhy et al. ..... 439/404
2005/0106946 A1* 5/2005 Doorhy et al. ..... 439/676
2005/0153603 A1* 7/2005 AbuGhazaleh et al. ..... 439/676
2005/0250372 A1* 11/2005 Doorhy et al. ..... 439/404
2005/0277340 A1* 12/2005 Gordon et al. ..... 439/676
2007/0099472 A1* 5/2007 AbuGhazaleh et al. ..... 439/344
2007/0105426 A1* 5/2007 AbuGhazaleh et al. ..... 439/344
2007/0161296 A1* 7/2007 Carroll et al. ..... 439/676
2007/0167061 A1* 7/2007 AbuGhazaleh et al. ..... 439/344
2007/0173103 A1* 7/2007 Ellis et al. ..... 439/404
2008/0026622 A1* 1/2008 Tomizu et al. ..... 439/247
2008/0188138 A1* 8/2008 Carroll et al. ..... 439/676

* cited by examiner

SLED THAT REDUCES THE NEXT VARIATIONS BETWEEN MODULAR PLUGS

BACKGROUND OF THE INVENTION

1. Field of the Invention

The present invention relates generally to the field of cable connectors. More specifically, the present invention relates to a sled used in a modular plug for terminating electric wires within a cable, such as twisted pairs terminated at an RJ-type plug.

2. Description of the Related Art

In the telecommunications industry, modular plug type connectors, such as RJ-type connectors, are commonly used to connect customer premise equipment (CPE), such as telephones and/or computers, to a jack on a wall outlet or another piece of CPE. These modular plugs are typically used to terminate twisted pair cabling or twisted pair cordage, collectively referred to as a twisted pair cable.

Termination of a twisted pair cable poses unique assembly problems for the skilled technician. For example, terminating four twisted pairs by means of an existing modular plug requires the following steps: First, the cable or cord jacket must be stripped to access the enclosed conductors. Next, because the conductors in a conductor pair are generally twisted around one another, the cord strand must be removed and the conductors oriented to align with the required interface. For some standardized plugs, aligning the conductors also involves separating the conductors in at least one of the pairs and routing these over or under conductors from other pairs, while orienting all the conductors in a side-by-side plane, thus, the orientation process can result in various conductors of different pairs crossing over each other, thereby inducing crosstalk among the several conductor pairs.

Crosstalk is defined as the cross coupling of electromagnetic energy between adjacent conductor pairs in the same cable bundle or jacket. Crosstalk can be categorized in one of two forms: Near End Crosstalk, commonly referred to as NEXT, is the most significant because the high energy signal from an adjacent conductor can induce relatively significant crosstalk into an attenuated receiver signal. The other form is Far End Crosstalk or FEXT. FEXT is typically less of an issue because the far end interfering signal is attenuated as it traverses the loop. Because the jack springs, conductors and the plug terminals or contacts near the jack springs are generally quite close to, and exposed to, one another in a communication plug, control of crosstalk is a paramount consideration in any plug design.

Unfortunately, crosstalk in a communication plug cannot be merely eliminated. Older plugs had relative high NEXT levels and also the NEXT level varied greatly in a plug-to-plug comparison. The drawbacks of older plug designs are discussed more fully in U.S. Pat. No. 6,056,586 of Lin, issued May 2, 2000, the disclosure of which is herein incorporated by reference.

Modern jacks are engineered to generate a certain amount of compensating crosstalk to counter the crosstalk produced in the plug. Accordingly, modern communication plugs should be designed to "optimize" rather than to minimize crosstalk. The term "optimize" is meant to convey that the crosstalk induced in a plug is controlled, and hence constant as compared to any other plug. Hence, if the induced NEXT in a plug is predictable, the jack can be accurately designed to compensate for that anticipated level of NEXT induced in the plug.

Accordingly, there exists an ongoing need for a modular plug for terminating a twisted pair cable, that provides a straightforward interface between the conductors in the cable and the plug terminals, that is easy to assembly, and that has substantially unvarying electrical characteristics from plug to plug.

Steps toward achieving these goals are disclosed in U.S. Pat. Nos. 6,250,949 and 7,425,159 of Lin, issued Jun. 26, 2001 and Sep. 16, 2008, respectively, the disclosures of which are herein incorporated by reference. U.S. Pat. Nos. 6,250,949 and 7,425,159 provide a modular plug that can be easily assembled by a technician. The plug includes a conductor organizing sled, which controls the routing and placement of the twisted pairs of conductors inside the plug. The conductor organizing sled helps to ensure that the lengths of the individual conductors, and relative placements of the individual conductors, inside the plug is relatively consistent from plug to plug. Hence, the plug designs disclosed in U.S. Pat. Nos. 6,250,949 and 7,425,159 help to "optimize" the NEXT, so that the NEXT of the plug can be effectively reduced by a NEXT compensation scheme within a jack.

Such a plug has been well accepted in the industry and vastly employed. However, there is always a trend toward faster transmission speeds and a further reduction of NEXT, such that future plug/jack combinations will need to "optimize" NEXT within the plug even further, as performance standards increase (such as the minimum performance characteristics defined by future CAT standards).

SUMMARY OF THE INVENTION

Applicants have appreciated drawbacks in the connectors of the background art. For example, the placement control of the center pair and the pair straddling the center pair in the current plugs may be improved upon. In the plug structures of the background art, it is possible for the center pair to sag downwardly relative to the sled, as it passes over an open area in the sled, or to elevate slightly upward prior to entering the blade channels or grooves. Also, the cross over point of the straddling pair and the center pair is not well controlled. Therefore, technicians can assemble plugs where the center and straddling pairs have slightly varying lengths, depending upon the variations in the above-mentioned areas, and hence the plug-to-plug NEXT can vary.

It is an object of the present invention to improve upon one or more of the mentioned drawbacks.

It is an object of the present invention to provide a sled structure which optimizes the NEXT introduced by the plugs.

These and other objects are accomplished by a connector plug which terminates a communication cable having a plurality of twisted pair conductors therein. The plug includes a conductor organizing sled, which includes structural features to minimize variations in conductor organization, as the conductors pass along the sled. By minimizing the variations as the conductors pass along the sled, technicians may assemble plugs having a relatively consistent level of crosstalk. The structural features of the organizing sled may include combinations of a ramp surface for a center pair, neck-down portions to cause consistent placement of stacked pairs, and crossing of stacked pairs to prevent a lower stacked pair from rising above a floor surface of the sled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein:

FIG. 2*b* is a top view of the housing of FIG. 2*a;*

DETAILED DESCRIPTION OF EMBODIMENTS OF THE INVENTION

Figures 1, 1B:
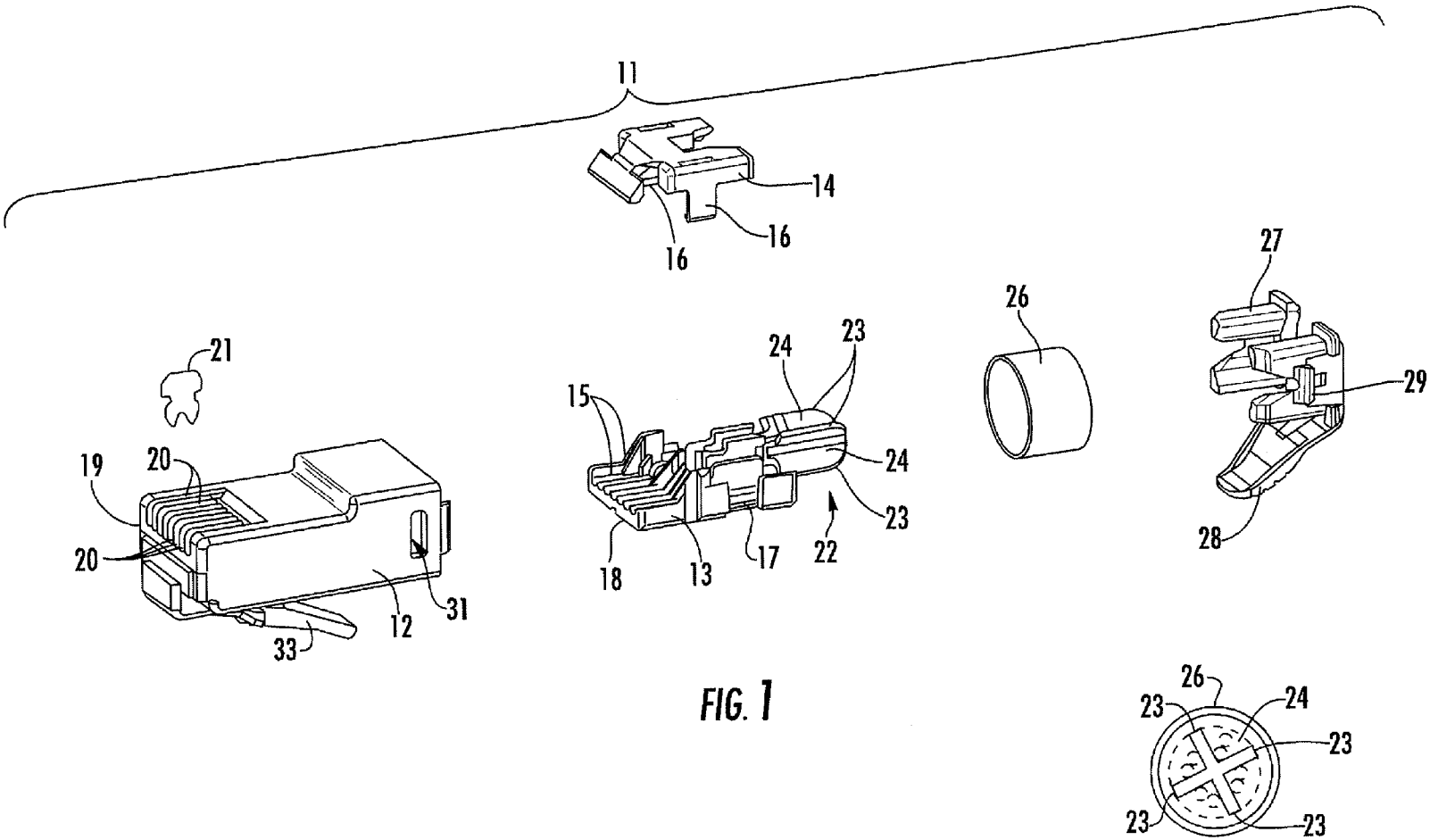
FIG. 1 is an exploded perspective view of the cable termination plug, in accordance with an embodiment of the present invention.
FIG. 1*b* is a cross-sectional view of the cruciform of a sled, as inserted within the cable.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

FIG. 1 is an exploded perspective view of the cable terminating plug 11 of the present invention, illustrating the several component parts thereof. Plug 11 comprises an outer housing member 12 having a hollow interior for housing a wire organizing sled 13. Preferably housing 12 is made of suitable dielectric (e.g., plastic) material. A cap or cover member 14, preferably of the same or similar material, has depending latch arms 16, the distal ends of which are configured to latch to the bottoms of slots 17 in sled 13.

The sled 13 is an elongated member having a longitudinal axis and also having a floor portion and first and second side walls. The connector end 18 of sled 13 has a plurality of channels, such as parallel grooves 15 therein which, as will be discussed more fully hereinafter, are adapted to hold the several wires from the cable (not shown in FIG. 1) in parallel relationship in a planar array. Housing 12 has, at its connector end 19, a conductor alignment region having a plurality (e.g., eight) slots 20 into which blade contact members 21 are insertable. Contact members 21 have sharp points for piercing the insulation of the wires lying in grooves 15 for making electrical contact therewith. Blades 21, in turn, are positioned in the slots 20 for making electrical contact with jack springs in the jack (not shown in FIG. 1) for receiving the plug 11.

Sled 13 at its cable termination end 22 has four septa 23 arranged in a cruciform configuration to create four wire pair channels or passages 24 (only two of which are shown in FIG. 1), which are parallel to the longitudinal axis. The distance between the distal edges of oppositely disposed septa is slightly less than the inner diameter of the protective sheath of the cable, so that the cable end 22 of the sled 11 may be inserted into the cable sheath.

A crimping ring or ferrule 26 of suitable metallic material has an inside diameter sufficient to allow it to be slipped over the cable end with the sled inserted therein. When the ring 26 is crimped, the cable sheath is held tightly against the distal edges of the septa 23, thereby insuring strain relief by its resistance to longitudinal or axial forces as shown in FIG. 1*b*. Because of this unique strain relief arrangement the wires and wire pairs of the cable, being situated in the channels 24, are not subject to lateral forces that tend to distort their orientation with respect to each other, as is common in old plug designs. Such distortion can produce changes or increases in crosstalk between the wires which is unpredictable and, therefore, to be avoided.

A split wedge collar 27, having a curved anti-snag arm 28 depending therefrom is adapted to fit over the crimped end of the cable for insertion into housing 12, where it is latched in place by means of latch members 29 on either side thereof which fit into latching slots 31 in housing 12. When collar 27 is latched in place, the sled 13 is locked in place within housing 12 and the plug 11 is then, in essence, a single unitary structure.

Figure 2A:
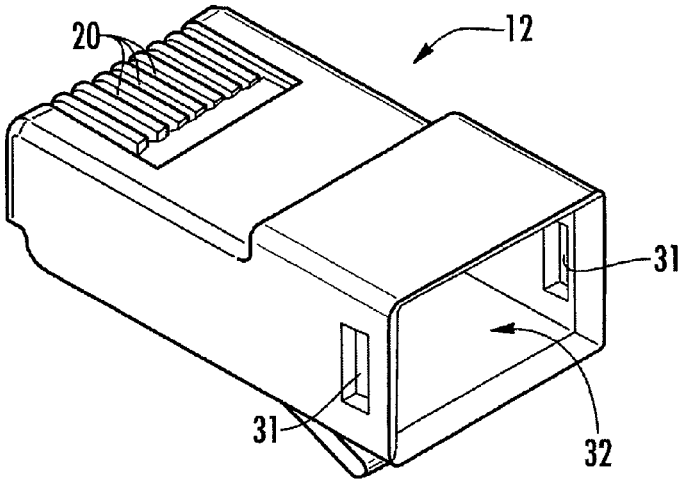
FIG. 2*a* is a perspective view of a housing of the plug of FIG. 1.
Figure 2C:
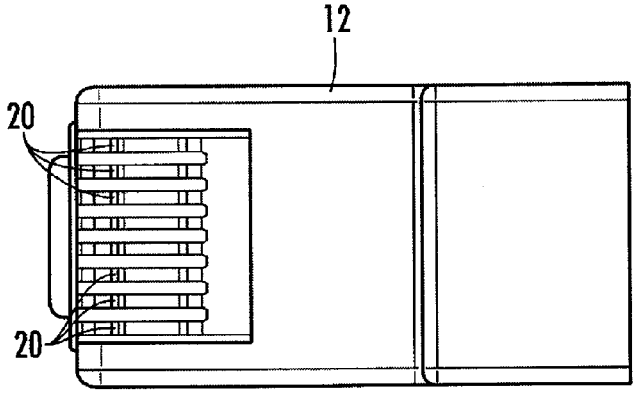
FIG. 2*c* is a side view of the housing of FIG. 2*a;*
Figure 2C:
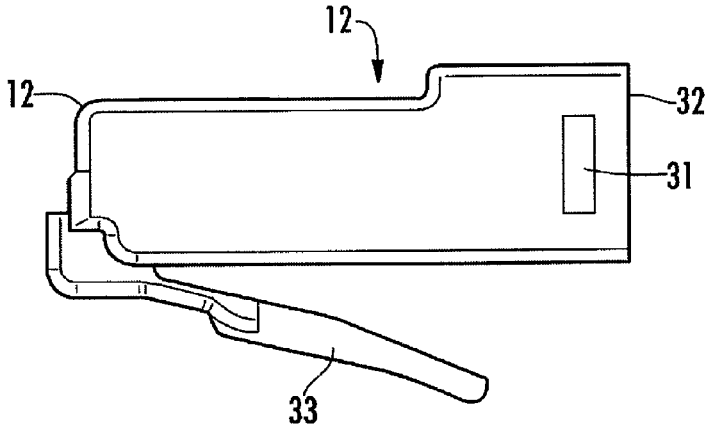

FIGS. 2*a* through 2*c* are several views of the housing 12. Housing 12 has an opening 32 to its hollow interior, the opening 32 and the interior being sized to receive the sled 13 when inserted therein. A latching arm 33 depends from housing 32 in an angular orientation, as best seen in FIGS. 1 and 2*c*, and is functional in locking and unlocking plug 11 from the jack or other receptacle into which it is inserted during use.

Figure 3:
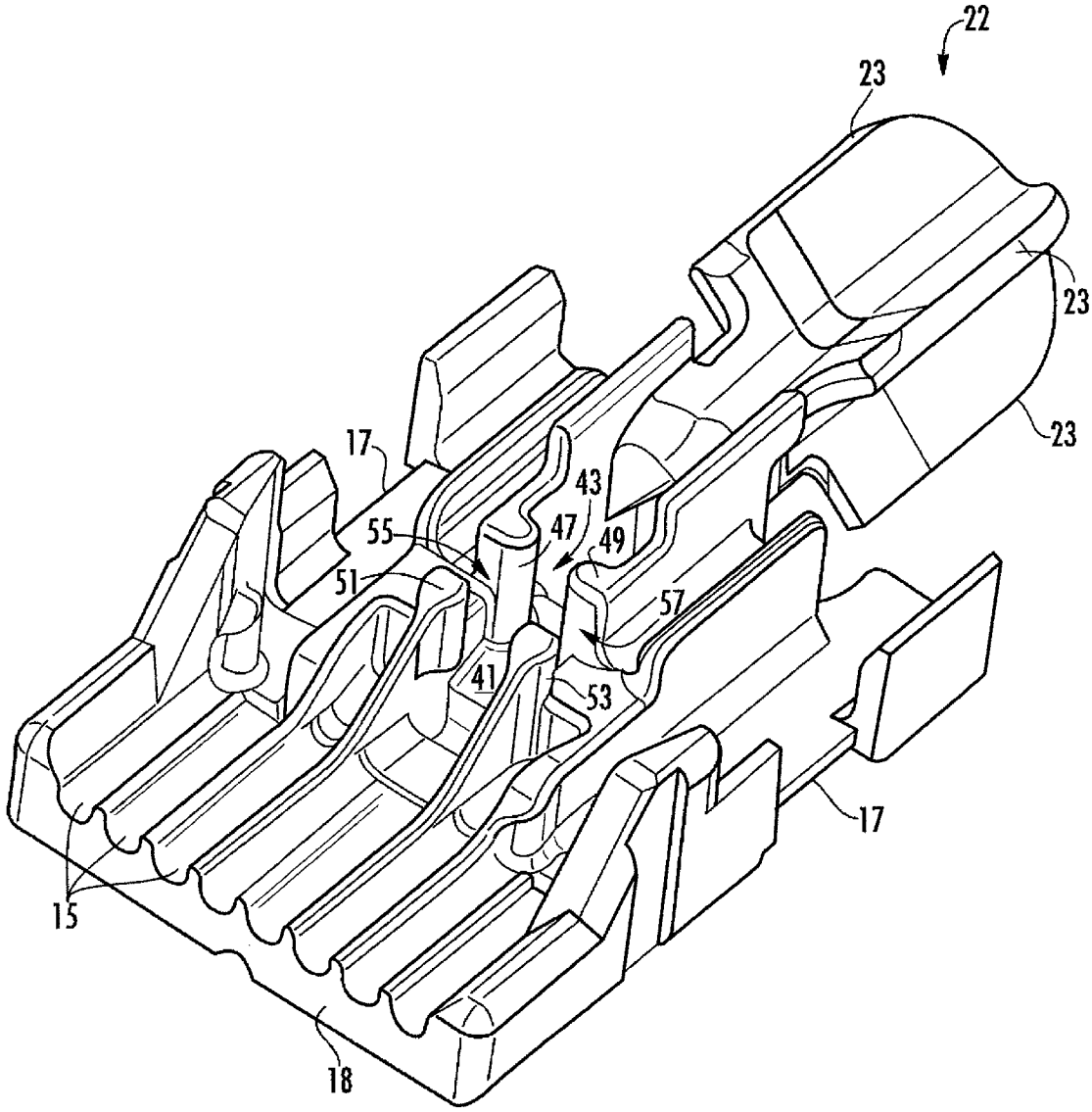
FIG. 3 is a perspective view the sled of FIG. 1.
Figure 4:
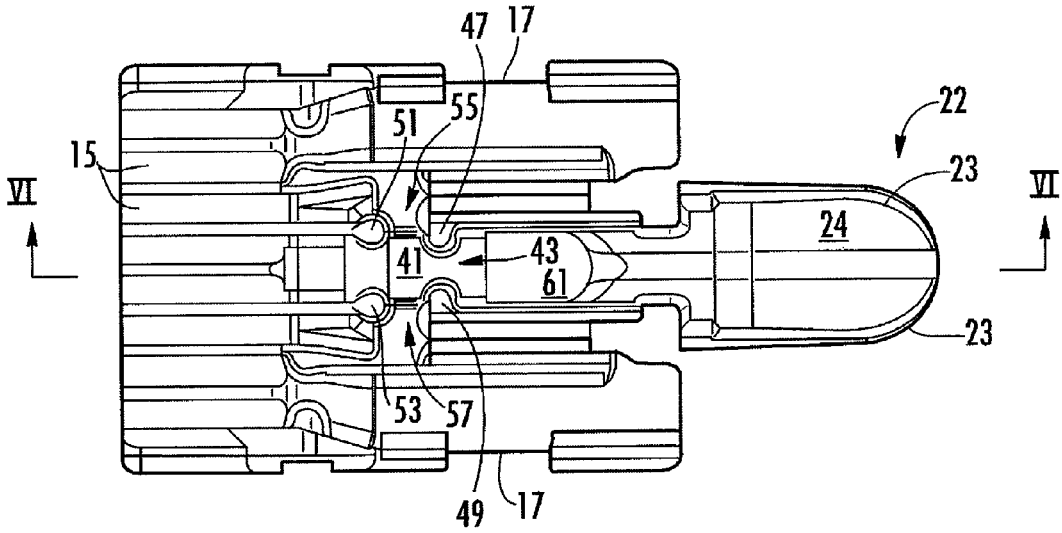
FIG. 4 is a top view of the sled of FIG. 3.
Figure 5:
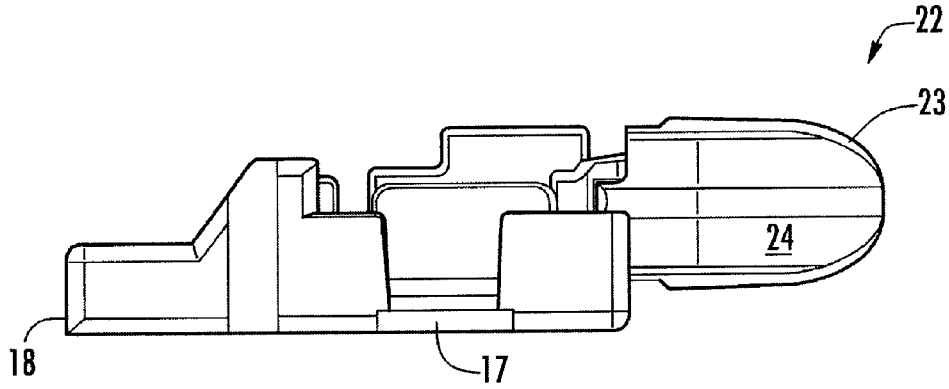
FIG. 5 is a side view of the sled of FIG. 3.
Figure 6:
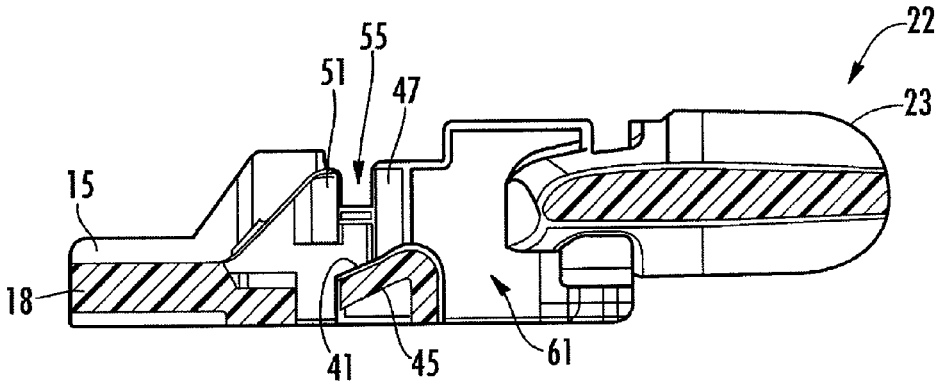
FIG. 6 is a cross sectional view taken along line VI-VI in FIG. 4.
Figure 7:
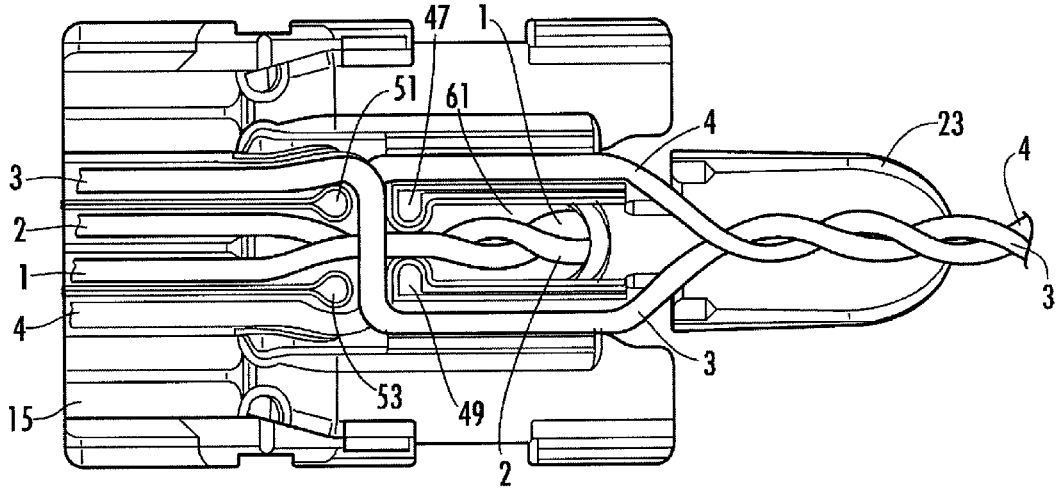
FIG. 7 is a top view similar to FIG. 4, but illustrating two sets of twisted pairs organized by the sled in a first arrangement.
Figure 8:
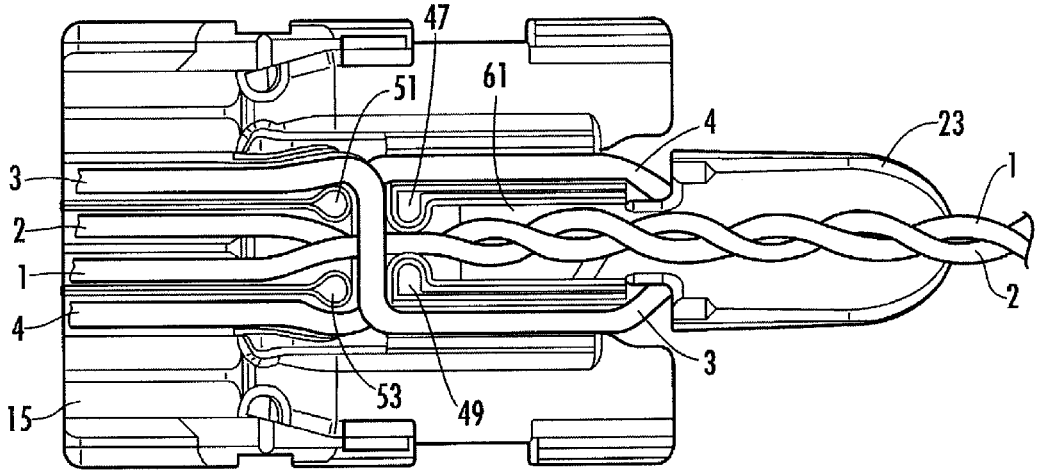
FIG. 8 is a top view similar to FIG. 4, but illustrating the two sets of twisted pairs organized by the sled in a second arrangement.
Figure 9:
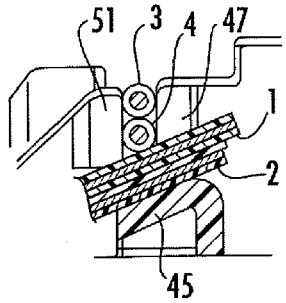
FIG. 9 is a close-up cross sectional view illustrating a crossing point between the two sets of twisted pairs, shown in FIGS. 7 and 8.

FIGS. 3 through 9 are several views of the sled 13 of the present invention. FIG. 3 is a perspective view the sled of FIG. 1. FIG. 4 is a top view of the sled of FIG. 3. FIG. 5 is a side view of the sled of FIG. 3. FIG. 6 is a cross sectional view taken along line VI-VI in FIG. 4. FIG. 7 is a top view similar to FIG. 4, but illustrating two sets of twisted pairs organized by the sled in a first arrangement. FIG. 8 is a top view similar to FIG. 4, but illustrating the two sets of twisted pairs organized by the sled in a second arrangement. FIG. 9 is a close-up cross sectional view illustrating a crossing point between the two sets of twisted pairs, shown in FIGS. 7 and 8.

In accordance with the present invention, the conductor organizing sled 13 includes a center floor 41 formed in a portion of the sled 13 between the septa 23 and the grooves 15. The center floor 41 defines a surface against which a center twisted pair 1, 2 (See FIGS. 7-9) of the plurality of twisted pairs must abut when passing from the septa 23 to the grooves 15. In one embodiment, the center floor 41 is formed atop a ramp 45 transitioning in relative elevation from the septa 23 down to the grooves 15, as best seen in the cross sectional view of FIG. 6.

The center floor 41 has a first neck-down portion 43 defining a first pathway. The first neck-down portion 43 is sized to only permit the center twisted pair 1, 2 to pass therethrough while in a first stacked alignment against the center floor 41, as best seen in FIGS. 7-9. In one embodiment, the first neck-down portion 43 is a limited width gap formed between a first column 47 and a second column 49. The first column 47 and the second column 49 extend in a direction which is substantially perpendicular to a plane of the array of grooves 15, e.g., into and out of the page with respect to FIGS. 4, 7 and 8.

In an embodiment illustrated in FIG. 9, the first column 47 and the second column 49 may have a length dimension in a direction which is substantially perpendicular to the plane of the array of grooves 15, which is about twice the length needed to accommodate the first stacked alignment of the center twisted pair 1, 2.

In a preferred embodiment, the center twisted pair 1, 2 passes through the septa 23, while remaining twisted. The center pair 1, 2 is then brought into a first stacked alignment and passed through the first neck-down portion 43. The center pair 1, 2 crosses the center floor 41. Then, the individual insulated wires 1 and 2 forming the center pair 1, 2 are separated to enter respective center grooves 15 of the plurality of grooves 15 formed in the array.

By this arrangement, the center pair 1, 2 is controlled in several ways on a plug-to-plug basis. First, the center pair 1, 2 is held in its twisted form while passing through the septa 23. Next, the center pair 1, 2 is placed in a stacked alignment in the first neck-down portion 43 consistently defining the twist stopping point on a plug-to-plug basis. Finally, the center floor 41 provides a surface to prevent the center pair 1, 2 from sagging downward, e.g., ensuring greater consistency in lengths for the center pair on a plug-to-plug basis.

In a further embodiment of the present invention, another or second twisted pair 3, 4, such as the straddling twisted pair, may be stacked above the center twisted pair 1, 2 while still abutting against side surfaces opposite the septa sides of the first and second columns 47 and 49. As best seen in FIGS. 7-9, the second twisted pair 3, 4, passes through the septa 23 and then is brought into a second stacked alignment. The second stacked alignment is substantially perpendicular to the plane of the array of grooves 15. The second stacked alignment of the another twisted pair 3, 4 abuts the first stacked alignment of the center twisted pair 1, 2, on a side of the first stacked alignment opposite to the center floor 41, as best seen in FIG. 9.

The second stacked alignment prevents any upward protrusion of the center twisted pair 1, 2, and the center floor 41 prevents downward sagging of the center twisted pair 1, 2. Therefore, the arrangement ensures greater consistency in lengths for the center pair 1, 2 on a plug-to-plug basis.

In accordance with the present invention, better control of the second twisted pair 3, 4 may also be accomplished. The sled 13 may also include a third column 51 and a fourth column 53. A second neck-down portion 55 is formed by a limited width gap between the first column 47 and the third column 51. The second neck-down portion 55 is sized to only permit the second twisted pair 3, 4 to pass therethrough while in a stacked alignment. A third neck-down portion 57 is formed by a limited width gap between the second column 49 and the fourth column 53. The third neck-down portion 57 is also sized to only permit the second twisted pair 3, 4 to pass therethrough while in a stacked alignment.

As best seen in FIGS. 7-9, the stacked aligned of the second pair 3, 4 passes over the stacked alignment of the center pair 1, 2. As illustrated in FIG. 9, at the abutment between the stacked alignment of the second pair 3, 4 and the stacked alignment of the center pair 1, 2, the second stacked alignment extends in a direction which is substantially perpendicular to an extension direction of the first stacked alignment.

By this arrangement, again, the center pair 1, 2 is better controlled because the center pair is sandwiched between the center floor 41 and the stacked alignment of the second pair 3, 4, e.g., ensuring greater consistency in lengths for the center pair on a plug-to-plug basis because the center pair 1, 2 cannot rise above the center floor 41. Also, by this arrangement, the second pair 3, 4 is better controlled on a plug-to-plug basis. The cross over point of the second pair 3, 4 is well defined, as it must exist in the mid-point between the second and third neck-down portions 55 and 57 on all plugs. If the third and fourth columns 51 and 53 (and hence the second and third neck-down portions 55 and 57) did not exist, the cross over point between the center pair 1, 2 and the second pair 3, 4 could have occurred anywhere between the first and second columns 47 and 49 and the start of the grooves 15, leading to lengths of the second pair 3, 4 varying on a plug-to-plug basis. The second and third neck-down portions 55 and 57 of the present invention help to ensure a uniform length of the second pair 3, 4 on a plug-to-plug basis.

FIG. 7 illustrates a first arrangement of the center and straddling pairs, where the center pair 1, 2 comes to the first neck-down portion 43 from a passage 61 formed in the sled 13 between the center floor 41 and the septa 23. FIG. 8 shows an alternative arrangement of the center and straddling pairs, where the center pair 1, 2 comes to the first neck-down portion 43 across the top of the passage 61. The arrangements of the center and straddling pairs in the septa 23 are merely illustrative, as other arrangements are possible. Also, other or additional pairs, besides the center and straddling pairs could be controlled by the features of the present invention.

More information regarding the structure and assembly of other parts used to form the plug 11, such as the cap member 14, ring 26 and split wedge 27 can be found in U.S. Pat. Nos. 6,250,949 and 7,425,159. However, it should be noted that, in general, the structures of the housing 12, top cap 14, ring 26 and split wedge 27 are unrelated to the improvements offered by the structure of the sled 13, in accordance with the present invention. The housing 12, top cap 14, ring 26 and split wedge 27 may be modified while maintaining the benefits of the optimized NEXT performance due to the new structural features of the sled 13 within the plug 11.

The new structural features of the sled 13 result in a plug 11 with a highly reproducible level of NEXT. In other words, there is remarkably little deviation in the NEXT measured between a given set of pairs in one plug as compared to the NEXT measured between the same set of pairs in another plug.

An object of the present invention is to reduce the variation or standard deviation in NEXT in the plugs 11. This is because a jack can be more easily engineered to accurately induce a given or fixed level of NEXT compensation, as compared to a plug 11. Typically, jacks will include a printed wiring board with crossed conductive traces and/or capacitors/inductors to induce the compensating NEXT. Such printed wiring boards are machine produced and can be easily replicated to produce a consistent level of compensating NEXT in one jack as compared to another jack.

Plugs, on the other hand, are usually installed on a cut end of a twisted pair cable by hand. The technician or assembly line worker must strip of portion of a surrounding jacket material, and carefully and consistently unwind a strand portion of the twisted wire pairs and insert them into the plug and fixed them to the plug's conductive terminals. Such human operators inevitably introduce variations in the manufacturing of the plugs, such that the NEXT of one plug will somewhat vary from the induced NEXT in the next plug.

U.S. Pat. Nos. 6,250,949 and 7,425,159, illustrated plug designs that improved the consistency of the assembly process from plug to plug. However, the structural features of the sled 13 of the present invention fixes the placements of wires as they cross the sled 13 (such as the center pair and straddling pair). The additional structures of the sled 13 of the present invention, which fix the placement of the certain wires in certain areas of the sled 13, removing several potential variations which a technician may introduce when assembling the wires on sleds constructed in accordance with U.S. Pat. Nos. 6,250,949 and 7,425,159.

The invention being thus described, it will be obvious that the same may be varied in many ways. For example, the sled 13 may be "metallized," in accordance with U.S. Pat. No. 7,425,159, in that the sled 13 may be formed of at least two materials, including a first material being a conductive material, such as metal, and a second material being a dielectric material, such as a plastic. Such variations are not to be regarded as a departure from the spirit and scope of the invention, and all such modifications as would be obvious to one skilled in the art are to be included within the scope of the following claims.

The invention claimed is:

1. A connector plug for terminating a communication cable having a plurality of twisted pair conductors therein, said connector plug comprising:

a housing; and a conductor organizing sled including:

a cable termination end with septa for receiving conductors of the communication cable;

a contact end having a plurality of grooves formed in an array for holding and orienting individual conductors in a particular alignment within said housing; and a center floor formed in a portion of said sled between said septa and said grooves, said center floor defining a surface against which a center twisted pair of the plurality of twisted pairs must abut when passing from said septa to said grooves, said center floor having a first neck-down portion sized to only permit the center twisted pair to pass therethrough while in a first stacked alignment against said center floor, such that the center twisted pair coming from said septa would pass through said first neck-down portion while in the first stacked alignment, then across said center floor.

2. The connector plug according to claim 1, wherein said center floor is formed atop a ramp transitioning in relative elevation from the septa down to the grooves.

3. The connector plug according to claim 1, wherein said first neck-down portion is a limited width gap formed between a first column and a second column.

4. The connector plug according to claim 3, wherein said first column and said second column extend in a direction which is substantially perpendicular to a plane of said array of grooves.

5. The connector plug according to claim 4, wherein said first column and said second column have a length dimension in a direction which is substantially perpendicular to the plane of said array of grooves, which is at least twice the length needed to accommodate the first stacked alignment of the center twisted pair.

6. The connector plug according to claim 5, further comprising:

the center twisted pair passing through said septa, through said first neck-down portion while in said first stacked alignment, then across said center floor, with the two conductors forming said center twisted pair then being separated to enter respective center grooves of said plurality of grooves formed in said array.

7. The connector plug according to claim 6, further comprising:

another twisted pair passing through said septa and then being brought into a second stacked alignment which is substantially perpendicular to the plane of said array of grooves, wherein said second stacked alignment of said another twisted pair abuts said first stacked alignment of said center twisted pair on a side of said first stacked alignment opposite to said center floor, such that said second stacked alignment prevents upward protrusion of said center twisted pair and said center floor prevents downward sagging of said center twisted pair.

8. The connector plug according to claim 7, wherein at the abutment between said second stacked alignment and said first stacked alignment, said second stacked alignment extends in a direction which is substantially perpendicular to an extension direction of said first stacked alignment.

9. The connector plug according to claim 1, wherein said housing has a plurality of slots formed therein and wherein said plurality of grooves formed in said array will be aligned with said plurality of slots in said housing when said conductor organizing sled is attached to said housing.

10. The connector plug according to claim 9, wherein said housing has a first end with an opening therein for receiving said conductor organizing sled when said conductor organizing sled is attached to said housing, and wherein said plurality of slots are formed in a second end of said housing.

11. The connector plug according to claim 10, further comprising:

a plurality of contact members, each contact member extending through one of said plurality of slots in said housing to make electrical contact with an individual conductor residing in one of said grooves formed in said array.

12. A connector plug for terminating a communication cable having a plurality of twisted pair conductors therein, said connector plug comprising:

a housing; and a conductor organizing sled including:

a cable termination end with septa for receiving conductors of the communication cable;

a contact end having a plurality of grooves formed in an array for holding and orienting individual conductors in a particular alignment within said housing; and a first column and a second column formed in a portion of said sled between said septa and said grooves, said first and second columns having a first pathway therebetween through which a center twisted pair of the plurality of twisted pairs may pass and said first and second columns having a length, substantially perpendicular to a plane of said array of grooves, which permits stacked conductors of another twisted pair to abut against sides of said first and second columns above the center twisted pair before passing to said grooves.

13. The connector plug according to claim 12, wherein said first pathway constitutes a first neck-down portion sized to only permit the center twisted pair to pass therethrough while in a stacked alignment.

14. The connector plug according to claim 13, wherein said sled further includes:

a third column formed in a portion of said sled between said septa and said grooves, wherein said first column and said third column form a second neck-down portion therebetween, sized to only permit the another twisted pair to pass therethrough while in a stacked alignment.

15. The connector plug according to claim 14, wherein said sled further includes:

a fourth column formed in a portion of said sled between said septa and said grooves, wherein said second column and said fourth column form a third neck-down portion therebetween, sized to only permit the another twisted pair to pass therethrough while in a stacked alignment.

16. The connector plug according to claim 15, further comprising:

the center twisted pair passing through said septa, and then through said first neck-down portion, with the two conductors forming said center twisted pair then being separated to enter respective center grooves of said plurality of grooves formed in said array; and the another twisted pair passing through said septa and then through said second and third neck-down portions, with the two conductors forming said another twisted pair then being separated to enter respective grooves of said plurality of grooves formed in said array.

17. The connector plug according to claim 12, wherein said housing has a plurality of slots formed therein and wherein said plurality of grooves formed in said array will be aligned with said plurality of slots in said housing when said conductor organizing sled is attached to said housing, and wherein said housing has a first end with an opening therein for receiving said conductor organizing sled when said conductor organizing sled is attached to said housing, and wherein said plurality of slots are formed in a second end of said housing.

18. The connector plug according to claim 17, further comprising:

a plurality of contact members, each contact member extending through one of said plurality of slots in said housing to make electrical contact with an individual conductor residing in one of said grooves formed in said array.

19. A connector plug for terminating a communication cable having a plurality of twisted pair conductors therein, said connector plug comprising:

a housing; and a conductor organizing sled including:

a cable termination end with septa for receiving conductors of the communication cable;

a contact end having a plurality of grooves formed in an array for holding and orienting individual conductors in a particular alignment within said housing; and a center floor formed in a portion of said sled between said septa and said grooves, said center floor defining a surface against which a center twisted pair of the plurality of twisted pairs must abut when passing from said septa to said grooves, said center floor having a first neck-down portion sized to only permit the center twisted pair to pass therethrough while in a first stacked alignment against said center floor, wherein said first first-neck down portion is formed by a first column and a second column and said first-neck down portion defines a first pathway, said first and second columns having a length, substantially perpendicular to a plane of said array of grooves, which permits stacked conductors of another twisted pair to abut against sides of said first and second columns above the center twisted pair before passing to said grooves.

20. The connector plug according to claim 19, wherein said sled further includes:

a third column formed in a portion of said sled between said septa and said grooves, wherein said first column and said third column form a second neck-down portion therebetween, sized to only permit the another twisted pair to pass therethrough while in a stacked alignment; and a fourth column formed in a portion of said sled between said septa and said grooves, wherein said second column and said fourth column form a third neck-down portion therebetween, sized to only permit the another twisted pair to pass therethrough while in a stacked alignment.

* * * * *